United States Patent [19]

Borchardt

[11] Patent Number: 4,536,304

[45] Date of Patent: Aug. 20, 1985

[54] METHODS OF MINIMIZING FINES MIGRATION IN SUBTERRANEAN FORMATIONS

[75] Inventor: John K. Borchardt, Duncan, Okla.

[73] Assignee: Halliburton Company, Duncan, Okla.

[21] Appl. No.: 653,669

[22] Filed: Sep. 21, 1984

[51] Int. Cl.[3] ..... E21B 43/12; E21B 43/25

[52] U.S. Cl. ..... 252/8.55 R; 166/307; 166/305.1; 252/8.55 C; 252/8.55 D; 405/264

[58] Field of Search ..... 252/8.55 R, 8.55 C, 252/8.55 D; 166/305 R, 307, 275; 405/264

[56] References Cited

U.S. PATENT DOCUMENTS 3,057,798 10/1962 Knox .
3,349,032 10/1967 Krieg .
3,434,971 3/1969 Atkins .
3,494,865 2/1970 Andrews, Jr. et al. .
3,562,226 2/1971 Gayley et al. .
3,704,750 12/1972 Miles et al. .
3,827,977 8/1974 Miles et al. .
3,832,302 8/1974 Lansford et al. .
3,868,328 2/1975 Boothe et al. .
3,916,994 11/1975 Maddox, Jr. et al. .
3,916,995 11/1975 Shupe et al. .
3,916,996 11/1975 Shupe et al. .
3,927,718 12/1975 Tate et al. .
3,943,060 3/1976 Martin et al. .
3,962,332 6/1976 Trapasso .
3,974,117 2/1977 Knox et al. .
4,055,502 10/1977 Swanson .
4,062,796 12/1977 Gardner et al. .
4,079,011 3/1978 Tate .
4,152,274 5/1979 Phillips et al. .
4,158,521 6/1979 Anderson et al. .
4,200,151 4/1980 Tate .
4,200,154 4/1980 Tate .
4,206,058 6/1980 Tate .
4,360,483 11/1982 Ayres .
4,366,071 12/1984 McLaughlin et al. .
4,366,072 12/1982 McLaughlin et al. .
4,366,073 12/1982 McLaughlin et al. .
4,366,074 12/1982 McLaughlin et al. .
4,374,739 2/1983 McLaughlin et al. .
4,377,710 3/1983 Seale et al. .
4,393,939 7/1983 Smith et al. .
4,404,377 9/1983 Seale et al. .
4,408,043 10/1983 Seale et al. .
4,425,242 1/1984 Penny et al. .
4,440,653 4/1984 Briscoe et al. .
4,447,342 5/1984 Borchardt et al. .
4,460,483 7/1984 Weaver .
4,462,718 7/1984 McLaughlin et al. .
4,497,596 2/1985 Borchardt et al. ..... 252/8.55 X

*Primary Examiner*—Herbert B. Guynn
*Attorney, Agent, or Firm*—Thomas R. Weaver; Edward F. Sherer

[57] ABSTRACT

A method of treating a permeable structure for the purpose of stabilizing fines in the structure. The method is carried out by contacting the fines with an effective amount of nitrogen-containing cationic perfluorinated compounds.

19 Claims, No Drawings

METHODS OF MINIMIZING FINES MIGRATION IN SUBTERRANEAN FORMATIONS

BACKGROUND OF THE INVENTION

This invention relates to a method of treating a permeable structure such as a subterranean formation using nitrogen-containing cationic perfluorinated compounds in order to stabilize, in the structure, migrating fines such as silica fines.

The recovery of fluids such as oil or gas or combinations thereof has been troublesome in areas where a subterranean formation is composed of one or more layers or zones which contain migrating fines such as silica, iron minerals, and alkaline earth metal carbonates. These fines tend to move or migrate to the well bore during the recovery of formation fluids from the particular layers or zones and frequently the migrating fines block the passageways leading to the well bore. The movement or migration of fines to the well bore is a particular problem when the fines are contacted with water foreign to the formation. Plugging or materially impairing the flow of the formation fluids towards the well bore results in a loss of these fluids to the producer and decreases the rate of hydrocarbon recovery from the well which may cause the well to be shut down because it is economically unattractive to produce therefrom. An additional adverse factor resulting from the movement of the fines towards the well bore is that they are often carried along with the formation fluids to the well bore and pass through pipes, pumps, etc., being used to recover the formation fluids to the surface with resulting damage to the moving parts as the fines are very abrasive.

Secondary and tertiary methods of recovering hydrocarbons from a subterranean formation are well known. In general, such a method involves introducing a fluid, such as water, steam, etc., into one or more injection wells which penetrate the formation and forcing the fluid toward one or more offset producing wells. Migrating fine particles during such an operation can decrease the permeability of the formation which may cause a decrease in the rate in which fluid can be injected into the formation which results in a decrease in the rate of hydrocarbon production at the offset production wells.

Migrating fine particles are frequently encountered during acidizing or fracturing operations and during sand consolidation operations. The presence of migrating fine particles during these operations can result in a decrease in the permeability of the formation which is being treated.

Gravel packing is a widely practiced method of preventing the production of sand from poorly consolidated formations. The migration of fine particles into the gravel pack can greatly reduce the permeability of the gravel pack. This can result in a decrease in the rate of production of hydrocarbons from the formation.

Consequently, in efforts to overcome these problems, various methods have been developed for treating a subterranean formation in order to stabilize portions of the formation containing migrating fines. For instance, U.S. Pat. Nos. 4,366,071; 4,366,072; 4,366,073; 4,366,074; 4,374,739; 4,460,483, and 4,462,718 disclose the use of organic polycationic polymers to prevent or reduce the ill effects of swelling clays or migrating fines or combinations thereof in subterranean formations.

These patents are assigned to the assignee of the present invention and are hereby incorporated by reference.

Furthermore, nitrogen-containing cationic perfluorinated compounds have been used in the past in relatively unrelated applications. U.S. Pat. Nos. 4,408,043; 4,404,377; and 4,377,710 disclose that nitrogen-containing cationic perfluorinated compounds have uses similar to those of commercial fluorocarbon surfactants and show utility in areas such as hydrocarbon emulsifiers in water, flotation aids, the treatment of porous substrates such as leather, wood, porous plastics and various natural or synthetic textiles to modify surface characteristics, oil and water repellents, general surfactants, additives for dry powder extinguisher compositions, antimicrobials, soil repellents, additives for polishes and waxes, corrosion inhibitors for oils and lubricants, foaming and wetting agents, and emulsifier and leveling agents for dye preparations.

U.S. Pat. No. 4,425,242, which is assigned to the assignee of the present invention and is hereby incorporated by reference, discloses the use of nitrogen-containing cationic perfluorinated compounds in a subterranean formation to reduce wetting by hydrocarbons and water of the surfaces of the subterranean formation.

U.S. Pat. No. 4,440,653, which is assigned to the assignee of the present invention and is hereby incorporated by reference, discloses the use of nitrogen-containing cationic perfluorinated compounds to prepare highly stable alcohol foams.

The present invention provides a method of stabilizing fines, such as silica fines, within a consolidated structure, such a subterranean formation, using nitrogen-containing cationic perfluorinated compounds which are effective in reducing the migration of fine particles in the consolidated structure.

SUMMARY OF THE INVENTION

The present invention involves the use of nitrogen-containing cationic perfluorinated compounds to prevent or reduce the ill effects of migrating fines such as silica fines in a permeable structure such as a permeable subterranean formation penetrated by a well bore. The method is carried out by contacting the fines in the permeable structure with an effective amount of the nitrogen-containing cationic perfluorinated compounds.

The nitrogen-containing cationic perfluorinated compounds used in the method of the present invention are very effective in treating migrating fines such as silica fines. The nitrogen-containing cationic perfluorinated compounds are particularly effective when used in conjunction with an acidizing operation that requires a strong mineral acid such as 15 percent by weight hydrochloric acid or mixtures of 3 percent by weight hydrofluoric acid and 12 percent by weight hydrochloric acid. In addition, the nitrogen-containing cationic perfluorinated compounds are particularly effective when used to treat permeable structures which have a permeability to water of less than 10 millidarcy. A treatment with the nitrogen-containing cationic perfluorinated compounds is essentially permanent and the nitrogen-containing cationic perfluorinated compounds are very resistant to being removed by brines, oils, or acids. Formations exhibit high permeability retention after the formations have been treated with the nitrogen-containing cationic perfluorinated compounds. Furthermore, the nitrogen-containing cationic perfluorinated compounds are very effective over a wide range of temperatures and are particularly effective from about 90° F. to about 200° F. No well shut-in time is required when the nitrogen containing cationic perfluorinated compounds are used to carry out the method of the invention.

DETAILED DESCRIPTION OF THE INVENTION

The present invention involves the use of nitrogen-containing cationic perfluorinated compounds to prevent the migration of fines such as silica fines contained in a permeable structure such as a subterranean formation. The use of the method of the invention results in stabilizing the permeable structure. The fines may or may not be present with clay materials. Preferably, the permeable structure which is to be treated, has a permeability of less than 10 millidarcy. The nitrogen-containing cationic perfluorinated compounds which are suitable for use in accordance with this invention comprise a nitrogen-containing cationic perfluorinated compound or mixtures of said compound having the following general formula:

FORMULA I

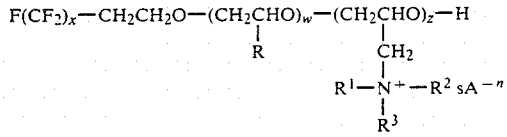

wherein

R is selected from the group consisting of hydrogen, methyl, ethyl, propyl, and mixtures thereof;

$R^1$, $R^2$, and $R^3$ are independently selected from the group consisting of methyl, ethyl, and mixtures thereof;

A is selected from the group consisting of chloride, bromide, iodide, sulfate, methyl sulfate, and mixtures thereof;

x is an integer in the range of from about 2 to about 12 or an integer or a fraction of an integer representing an average value in the range of from about 2 to about 12;

w is an integer in the range of from about 2 to about 20 or an integer or a fraction of an integer representing an average value of from about 2 to about 20;

z is an integer in the range of from about 1 to about 20 or an integer or a fraction of an integer representing an average value of from about 1 to about 20; and, n represents the valency of the anion represented by A; and, s is an integer equal to the number of said anions required to maintain electronic neutrality.

The nitrogen-containing cationic perfluorinated compounds of the present invention can be used to treat both natural and artificial structures which are permeable including poorly consolidated and unconsolidated rocks. The method of the invention is particularly suited for stabilizing fine particles in a subterranean formation which has a permeability of less than 10 millidarcy. Furthermore, there is a wide range of application for the nitrogen-containing cationic perfluorinated compounds. These applications involve using the nitrogen-containing cationic perfluorinated compounds alone, as the primary treating agent, or as an auxiliary in other treatments.

In the above Formula I, R is preferably selected from the group consisting of hydrogen, methyl, and mixtures thereof; $R^1$, $R^2$, and $R^3$ are preferably selected from the group consisting of methyl, ethyl, and mixtures thereof; x is preferably an integer or a fraction of an integer representing an average value of from about 6 to about 8; w is preferably an integer or fraction of an integer representing an average value of from about 1 to about 3; z is preferably an integer or a fraction of an integer representing an average value of from about 6 to about 8; and A is preferably chloride.

The most preferred nitrogen-containing cationic perfluorinated compound for use in the present invention is represented by the following formula:

FORMULA II

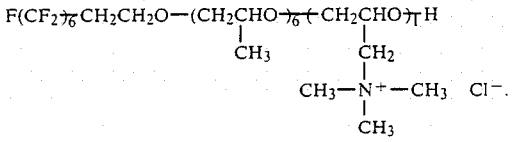

Methods of preparing the nitrogen-containing cationic perfluorinated compounds which are used in the method of the present invention are well known in the art and are disclosed in U.S. Pat. No. 4,408,043, which is hereby incorporated by reference.

The amount of nitrogen-containing cationic perfluorinated compound employed in the method of the present invention will vary according to, for example, the size and porosity of the particular permeable structure and the types of fines present therein. Therefore, there are no upper or lower limits in this regard.

Any suitable method of application can be used to carry out the method of the invention. For some applications such as surface or exposed structures, it may be desirable to merely spray the nitrogen-containing cationic perfluorinated compound onto the permeable mass. The essential feature is contact between the fines to be treated and the nitrogen-containing cationic perfluorinated compound.

When a carrier fluid is used to carry out the method of the invention, the nitrogen-containing cationic perfluorinated compound will generally be present in the carrier fluid in a concentration in the range of from about 0.01 percent to about 5.0 percent by weight of the carrier fluid. Lower or higher concentrations can be used, but are not generally as practical. When a carrier fluid is used, the preferred concentration of the nitrogen-containing cationic perfluorinated compound is in the range of from about 0.25 to about 1.0 percent by weight of the carrier fluid.

Carrier fluids which can be used to carry out the method of the present invention include polar and nonpolar fluids. Examples of suitable fluids include water, brine, aqueous solutions of low molecular weight alcohols, ketones, and monoethers of glycol. Examples of suitable low molecular weight alcohols include methanol, ethanol, and isopropanol. When water is used as the carrier fluid, the carrier fluid can contain other ingredients which do not substantially interfere with the dispersion or dissolution of the nitrogen-containing cationic perfluorinated compound in the carrier fluid. Furthermore, the water can be gelled or thickened for certain applications. Examples of ingredients which can be included in the water include salts, mineral acids, low molecular organic acids, cationic or nonionic surfactants, and wetting agents. The only limitation with regard to ingredients which can be included in the water containing the nitrogen-containing cationic perfluorinated compound is that ingredients should not be added which effect the ability of the nitrogen-containing cationic perfluorinated compounds to reduce or prevent the migration of fines in the permeable structure. It has been found that cationic polymers containing two nitrogen moieties reduce the effectiveness of the nitrogen-containing cationic perfluorinated compounds.

Preferably, the carrier fluid has a viscosity of less than 10 centipoises. Higher viscosity fluids may be used in certain application but are not generally very practical due to the pressure and pumping requirements. A preferred aqueous carrier fluid is a saline solution containing about 0.1 to about 40.0 percent by weight of salt. The preferred salt concentration is about 2 to about 12 percent by weight of the solution. The salt can be an alkali metal salt, an alkaline earth metal salt, an ammonium salt or mixtures thereof. Examples of suitable anions include halides, such as chloride, bromide, iodide, and fluoride, sulfates, carbonates, hydroxides, and mixtures thereof. The halides of potassium, sodium, magnesium, calcium, ammonium and mixtures thereof are preferred due to economics and solubility. Aqueous acids having a concentration of about 0.1 to about 20.0 percent by weight of the solution can also be utilized in carrying out the method of the invention. Examples of suitble acids include hydrochloric acid, hydrofluoric acid, phosphoric acid, acetic acid, formic acid, citric acid, and mixtures thereof. The preferred acids include about 3 to about 15 percent by weight of hydrochloric acid and a mixture of about 3 percent by weight hydrofluoric acid and about 12 percent by weight hydrochloric acid.

The method of the present invention can be used in a number of operations. For instance, the method of the present invention can be used in conjunction with sand consolidation procedures, gravel packing procedures, secondary recovery operations, and acidizing or fracturing operations. In these operations, the nitrogen-containing cationic perfluorinated compounds can be used to prevent or reduce the migration of fines in the subterranean formation. This results in a greater increase of permeability in the formation.

In addition to stabilizing fines in a subterranean formation, the nitrogen-containing cationic perfluorinated compounds are also effective in reducing the wetting of surfaces by water and hydrocarbons in subterranean formations. Thus the method of the present invention can be used in conjunction with reducing the wetting of surfaces by water and hydrocarbon in subterranean formations by means of a single step, namely, contacting the formation with the nitrogen-containing cationic perfluorinated compounds.

The present invention is further exemplified by the examples below which are presented to illustrate certain specific embodiments of this invention but are not intended to be construed so as to be restrictive of the scope and spirit thereof.

EXAMPLES

A series of tests were performed to determine the effectiveness of the nitrogen-containing cationic perfluorinated compounds of Formula I as fine stabilizers. The nitrogen-containing cationic perfluorinated compound used in the tests is set forth below in Table I.

TABLE I

| Compound Designation | Structural Formula |
|---|---|
| A | $F(CH_2)_5CH_2CH_2O(CH_2\overset{CH_3}{\overset{\vert}{C}}HO)_{6-8}CH_2\overset{OH}{\overset{\vert}{C}}HCH_2N^+(CH_3)_3\,Cl^-$ |

EXAMPLE I

A. Test Equipment and Procedure

The test equipment used in tests of Example I was a TEFLON sleeved test chamber having a diameter of about 2.6 cm at the bottom of the chamber and a diameter of about 2.5 cm at the top of the chamber. The chamber design insured that, under modest applied pressure, fluid injected during the test would flow through the test sand rather than around the test sand. The test sand comprised 100 grams of a mixture of 85 percent by weight 70–170 U.S. mesh sand and 15 percent by weight silica fine particles. The silica fine particles had a median particle diameter of 22.4 microns and surface area of 1.20 $m^2$/gram. A 100 U.S. mesh screen was placed at the base of the chamber to hold the larger particles in place.

The test chamber and fluid reservoir were heated to about 145° F. unless otherwise noted. The first fluid injected into the top of the chamber during the tests comprised 236 cc of an aqueous solution containing 2 percent by weight of ammonium chloride and various concentrations of the nitrogen-containing cationic perfluorinated compound. The injection pressure was 5 psia.

Included in these tests were treatments in which no nitrogen-containing cationic perfluorinated compound was added to the fluid. After completion of the injection of the first fluid, the injection pressure was increased to 40 psig and 500 cc of mesh water was injected. The fresh water treatment was optionally followed by an injection at 40 psig of 400 cc of an aqueous fluid comprising 15 percent by weight of hydrochloric acid and an injection at 40 psig of 500 cc of fresh water.

The effluent of each treatment was collected and filtered through a tared piece of 0.45 micron filter paper. The solids from the effluent were collected in the filter paper, dried, and weighed. The results of these tests are shown in Table II.

TABLE II

| Test No. | Treatment Solution | Fines Production(g) During Injection of: Treatment Solution | Fresh $H_2O$ | 15% HCl | Fresh $H_2O$ | Total Fines Production (g) |
|---|---|---|---|---|---|---|
| 1 | 2% $NH_4Cl$ | 0.00 | 0.21 | 0.05 | 0.08 | 0.34 |
| 2 | 0.48% A/2% $NH_4Cl$ | 0.00 | 0.07 | 0.00 | 0.00 | 0.09 |
| 3 | 0.48% A/2% $NH_4Cl$ | 0.00 | 0.05 | 0.03 | 0.01 | 0.09 |
| 4[a] | 0.54% A/2% $NH_4Cl$ | 0.00 | 0.11 | 0.02 | 0.12 | 0.25 |

TABLE II-continued

| Test No. | Treatment Solution | Fines Production(g) During Injection of: Treatment Solution | Fresh $H_2O$ | 15% HCl | Fresh $H_2O$ | Total Fines Production (g) |
|---|---|---|---|---|---|---|
| 5[a] | 0.48% A/29.7%[b] $CH_3OH$/0.04%[b] EGMBE[c]/ 2% $NH_4Cl$ | 0.12 | 0.16 | 0.09 | 0.03 | 0.40 |

[a]Temperature of tests was 200° F.
[b]Percent by volume.
[c]Ethylene glycol monobutyl ether.

Test No. 1 did not utilize the nitrogen-containing cationic perfluorinated compounds of Formula I. This test was a control test to determine the amount of silica fines produced in the absence of the nitrogen-containing cationic perfluorinated compound. An amount of 0.21 g of fines was produced during the injection of 500 cc of fresh water and a total of 0.34 g of fines were produced after injection of the fluids. These amounts were defined, for calculation purposes, as 100 percent fines production.

The test results reported in Table II show that compound A was very effective in stabilizing silica fines. Prior to acid injection, the silica fines production from compound A treated test columns, which is reported in Tests 2 and 3, was 23.8 to 33.3 percent of the control test column which was reported in Test 1. During and after acid injection, the silica fines production from compound A treated test columns was 15.4 to 30.8 percent of the untreated test column. Overall fines production from compound A treated test columns was 26.5 percent of the control test column.

The test summarized in Test 4 of Table II was performed at 200° F. The silica fines production was 73.5 percent of the control test column.

In Test 5 of Table II, silica fines production was higher than the previous tests. The reason for this result is not understood. Although the test procedure used for Test 5 was the same as Tests 1 through 4, it is possible that the results reported were due to procedural problems in performing these tests. Examples of possible procedural problems include difficulties in packing the test columns and a hole in the 100 U.S. mesh screen allowing additional solids to pass through the screen.

EXAMPLE II

A flow study was performed using Berea formation core from Ashland County, Ohio. The X-ray diffraction analysis of the core is shown in Table III.

TABLE III

| X-Ray Diffraction Analysis of Berea Formation Cores | |
|---|---|
| Mineral | % Present |
| Quartz | 50–65 |
| Feldspar | 10–15 |
| Calcite | 0 |
| Dolomite | 0 |
| Total Clays | 9.5–22 |
| Kaolinite | 5–10 |
| Illite | 2–5 |
| Chlorite | 0.5–2 |
| Mixed Layer | 2–5 |
| Sodium Chloride | 2–5 |

Previous studies indicated the core to comprise silty sandstone, quartz, feldspar, and mica flakes thinly coated with a mixed layer of clay with the intergrain pore space partially filled with quartz overgrowth and paolinite. The data shown in Table III indicated that migrating fines were likely to be quartz, feldspar, kaolinite, illite, and a mixed layer of clay particles.

The standard brine used in the study comprised 7.50 parts by weight sodium chloride, 0.55 parts by weight calcium chloride, 0.42 parts by weight magnesium chloride hexahydrate, and 91.53 parts by weight deionized water.

The flow test was performed at 140° F. The Berea formation core was placed into a standard Hassler sleeve assembly. Annulus pressure was 250 psig. Core hydration pressure was 50 psig. The pressure was increased to 100 psig for the fluid injection. The standard laboratory brine passed through an in-line 2 micron filter prior to injection into the core.

The treatment fluid was prepared from an aqueous 2 percent by weight ammonium chloride solution. The ammonium chloride solution was filtered using a 0.45 micron filter. The treatment fluid contained 0.07 percent by weight compound A, 1.0 percent by weight water, 70.9 percent by weight aqueous 2 percent ammonium chloride, 28.0 percent by weight methanol and 0.1 percent by weight ethylene glycol monobutyl ether. The purpose of the methanol and ethylene glycol monobutyl ether was to reduce the rate of adsorption of compound A on mineral surfaces. This allowed more of the test core to be treated with compound A.

After injection of the first 100 pore volumes of standard laboratory brine, the core became saturated and the flow rate and core permeability stabilized. Subsequent brine injection resulted in a continuously decreasing core permeability. Since the brine was sufficiently saline, it is believed that it did not cause swelling of the water-soluble clays. Since the brine was filtered immediately prior to injection, the permeability damage appeared to be due to fines migration. After injection of the laboratory brine, the treatment fluid was injected. Subsequent brine injection exhibited a reduced rate of permeability decline. The results of the flow study are set forth below in Table IV.

TABLE IV

| Fluid | Cumulative Throughput: cc | Pore Volume | Perm. (md) |
|---|---|---|---|
| 550 cc Standard | 50 | 16.7 | 5.6 |
| Laboratory Brine | 100 | 33.3 | 5.6 |
| | 150 | 50.0 | 5.5 |
| | 200 | 66.7 | 5.5 |
| | 250 | 83.3 | 5.4 |
| | 300 | 100 | 5.4 |
| | 350 | 116.7 | 5.0 |
| | 400 | 133.3 | 5.1 |
| | 450 | 150 | 4.8 |
| | 500 | 166.7 | 4.8 |
| | 550 | 183.3 | 4.7 |
| 600 cc/1% by weight Compound A | 600 | 383.3 | — |
| 300 cc Standard | 650 | 400 | 3.2 |
| Laboratory Brine | 700 | 416.7 | 3.6 |
| | 750 | 433.3 | 3.4 |

TABLE IV-continued

| Fluid | Cumulative Throughput cc | Pore Volume | Perm. (md) |
|---|---|---|---|
| | 800 | 450.0 | 3.3 |
| | 850 | 466.7 | 3.2 |
| | 900 | 483.3 | 2.9 |
| | 950 | 500.0 | 2.9 |

The decline rate prior to treatment was 0.8 md/100 pore volumes. This decreased to 0.3 md/100 pore volumes after core treatment with compound A. The significantly reduced rate of permeability damage was indicative that compound A effectively stabilized a mixture of fines comprising quartz fines, feldspar, and migrating clays including kaolinite, illite, and mixed layer clays.

EXAMPLE III

Flow tests were performed to determine formation damage characteristics and fines stabilization properties of compound A using formation core from the Marnoso Aremacea Formation. Cores used in the tests were 0.94 inches in diameter and from about 1.1 to about 1.2 inches in length and were mounted in an epoxy resin such that fluid flow was oriented horizontally with respect to the rock formation. The permeability to nitrogen of the core was determined using the Klinkenberg method. Test temperature was 180° F. The test fluid was injected and the initial and final permeability to the test fluid was determined. The post-treatment permeability to nitrogen was then determined using the Klinkenberg method.

Aqueous 2% ammonium chloride was the first fluid tested. Treatment volume was 80 cc. It is believed that this fluid does not cause the swelling of water-expandable clays. The post-treatment nitrogen permeability of the core was, however, 64.7% of its pretreatment value.

The second fluid tested was an aqueous composition containing 2% by weight KCl and 0.01% by weight compound A. Ethylene glyol monobutyl ether and methanol were added to the fluid to decrease the adsorption rate of compound A on formation surface of the core. This permitted deeper penetration of compound A into the test core. Post-treatment nitrogen permeability of the cores was determined using Klinkenberg method. The results of these tests are shown in Table V.

TABLE V

| Test No. | Fluid[a] | Permeability (md) To Nitrogen | Test Fluid Initial | Test Fluid Final | Nitrogen |
|---|---|---|---|---|---|
| 1. | 2% $NH_4Cl$ | 176.4 | 26.5 | 29.1 | 114.2 |
| 2. | 0.019% A/ 0.01% EGMBE[b]/ 25% $CH_3OH$[c]/2% KCl | 123.5 | 21.6 | 24.8 | 124.3 |

[a]Percent by weight unless otherwise noted.
[b]Percent by volume ethylene glycol monobutyl ether.
[c]Percent by volume methanol.

The results of these tests show that post-treatment permeability of Test 2 was not decreased from its pretreatment value but there was a 35.3 percent decrease in the permeability of the core in Test 1. The fluid used in Test 1 did not contain compound A.

This invention is not limited to the above-described specific embodiments thereof; it must be understood therefore, that the detail involved in the description of these embodiments in presented for the purposes of illustration only, and that reasonable variations and modifications, which will be apparent to those skilled in the art, can be made of this invention without departing from the spirit and scope thereof.

What is claimed is:

1. A method of preventing or reducing the migration of silica fines in a permeable subterranean formation comprising: contacting said fines in said permeable subterranean formation with an effective amount of a nitrogen-containing cationic perfluorinated compound or mixtures of said compound represented by the formula

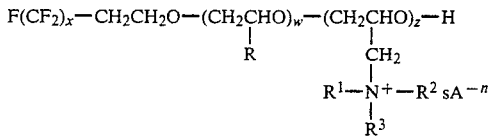

wherein

R is selected from the group consisting of hydrogen, methyl, ethyl, propyl, and mixtures thereof;

$R^1$, $R^2$, and $R^3$ are independently selected from the group consisting of methyl, ethyl, and mixtures thereof;

A is selected from the group consisting of chloride, bromide, iodide, sulfate, methyl sulfate, and mixtures thereof;

x is an integer in the range of from about 2 to about 12 or an integer or a fraction of an integer representing an average value of from about 2 to about 12;

w is an integer in the range of from about 2 to about 20 or an integer or a fraction of an integer representing an average value of from about 2 to about 20;

z is an integer in the range of from 1 to about 20 or an integer or a fraction of an integer representing an average value of from 1 to about 20;

n represents the valency of the anion represented by A; and, s is an integer equal to the number of said anions required to maintain electronic neutrality.

2. The method recited in claim 1 wherein R is selected from the group consisting of hydrogen and methyl.

3. The method recited in claim 2 wherein $R^1$, $R^2$, and $R^3$ are independently selected from the group consisting of methyl, ethyl, and mixtures thereof.

4. The method recited in claim 3 wherein x is an integer of from about 6 to about 8.

5. The method recited in claim 4 wherein w is an integer of from about 1 to about 3.

6. The method recited in claim 5 wherein z is an integer of from about 6 to about 8.

7. The method recited in claim 2 wherein said formation has a permeability of less than 10 millidarcy.

8. The method recited in claim 6 wherein said compound or mixtures of said compound are dispersed in a carrier fluid.

9. The method recited in claim 8 wherein said carrier fluid comprises from about 0.1 to about 40.0 percent by weight of a salt and said salt is selected from the group consisting of an alkali metal halide, an alkaline earth metal halide, an ammonium halide, and mixtures thereof.

10. The method recited in claim 9 wherein said compound or mixtures of said compound are present in said carrier fluid in the range of from about 0.01 to about 5.0 percent by weight of the carrier fluid.

11. The method recited in claim 10 wherein said carrier fluid further comprises a mineral acid selected from the group consisting of hydrofluoric acid, hydrochloric acid, and mixtures thereof.

12. The method recited in claim 11 wherein said method is used in conjunction with a secondary recovery operation.

13. The method recited in claim 1 wherein said cationic perfluorinated compound is represented by the following formula:

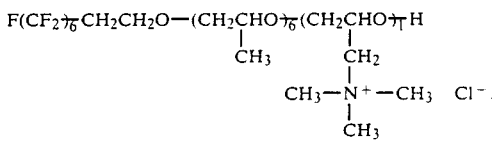

14. A method of treating an earthen formation comprising silica fines to reduce less of permeability in said formation because of the migration of said silica fines comprising: contacting said formation with an effective amount of a nitrogen-containing cationic perfluorinated compound or mixtures of said compound represented by the formula

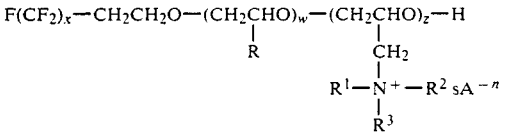

wherein

R is selected from the group consisting of hydrogen, methyl, ethyl, propyl, and mixtures thereof;

$R^1$, $R^2$, and $R^3$ are independently selected from the group consisting of methyl, ethyl, and mixtures thereof;

A is selected from the group consisting of chloride, bromide, iodide, sulfate, methyl sulfate, and mixtures thereof;

x is an integer in the range of from about 2 to about 12 or an integer or a fraction of an integer representing an average value of from about 2 to about 12;

w is an integer in the range of from about 2 to about 20 or an integer or a fraction of an integer representing an average value of from about 2 to about 20;

z is an integer in the range of from 1 to about 20 or an integer or a fraction of an integer representing an average value of from 1 to about 20;

n represents the valency of the anion represented by A; and, s is an integer equal to the number of said anions required to maintain electronic neutrality.

15. The method recited in claim 14 wherein said formation has a permeability of less than 10 millidarcy.

16. The method recited in claim 15 wherein R is selected from the group consisting of hydrogen, methyl, and mixtures thereof.

17. The method recited in claim 16 wherein $R^1$, $R^2$, and $R^3$ are independently selected from the group consisting of methyl, ethyl, and mixtures thereof.

18. The method recited in claim 17 wherein x is an integer of from about 6 to about 8; w is an integer of from about 1 to about 3; and z is an integer of from about 6 to about 8.

19. The method recited in claim 18 wherein said compound or mixtures of said compounds are dispersed in a carrier fluid in an amount in the range of from about 0.01 to about 5.0 percent by weight of said carrier fluid.

* * * * *

UNITED STATES PATENT AND TRADEMARK OFFICE

CERTIFICATE OF CORRECTION

PATENT NO. : 4,536,304

DATED : August 20, 1985

INVENTOR(S) : John K. Borchardt

It is certified that error appears in the above-identified patent and that said Letters Patent is hereby corrected as shown below:

Column 5, at line 34, delete the word "suitble" and insert therefore --suitable--.

Column 11, at line 25, delete the word "less" and insert therefore --loss--.

Signed and Sealed this

*Eleventh* Day of *February 1986*

[SEAL]

*Attest:*

DONALD J. QUIGG

*Attesting Officer*

*Commissioner of Patents and Trademarks*